US006438779B1

(12) United States Patent
Brown

(10) Patent No.: US 6,438,779 B1
(45) Date of Patent: Aug. 27, 2002

(54) KNEE PILLOW

(76) Inventor: Eric J. Brown, 11 Maddux St., San Francisco, CA (US) 94124

( * ) Notice: Subject to any disclaimer, the term of this patent is extended or adjusted under 35 U.S.C. 154(b) by 0 days.

(21) Appl. No.: 09/709,196

(22) Filed: Nov. 10, 2000

(51) Int. Cl.[7] ..... A47C 16/00; A47C 20/00; A47G 9/00; A61H 1/00

(52) U.S. Cl. ..... 5/648; 5/639; 5/915; 128/845; 602/24; 601/57

(58) Field of Search ..... 5/648, 639, 915; D6/601; 128/845, 892; 601/56, 57, 58; 602/24

(56) References Cited

U.S. PATENT DOCUMENTS 2,786,465 A * 3/1957 Moxley ..... 5/915 X
2,840,071 A * 6/1958 McNair ..... 601/57
2,850,009 A * 9/1958 McElwee ..... 601/18
2,943,620 A * 7/1960 Sibert ..... 5/915 X
2,943,621 A * 7/1960 Phillips et al. ..... 5/915 X
3,019,785 A * 7/1962 Eiden ..... 601/58
3,457,611 A * 7/1969 Carpenter ..... 5/915 X
3,580,245 A * 5/1971 Dill ..... 601/57
3,604,023 A * 9/1971 Lynch ..... 5/650
3,727,308 A * 4/1973 Dill ..... 601/57
4,135,504 A * 1/1979 Spann ..... 602/24
4,136,685 A 1/1979 Ramey
4,177,806 A 12/1979 Griffin
4,228,793 A * 10/1980 Ramey ..... 5/639 X
4,327,714 A * 5/1982 Spann ..... 602/24
4,372,299 A * 2/1983 Fixel ..... 602/24
4,392,489 A * 7/1983 Wagner, Sr. ..... 602/24
4,433,678 A * 2/1984 Spann ..... 602/24
4,584,730 A * 4/1986 Rajan ..... 5/632
4,736,477 A * 4/1988 Moore ..... 5/648
4,787,106 A * 11/1988 Paxon ..... 5/648
4,805,605 A * 2/1989 Glassman ..... 602/24
4,889,109 A * 12/1989 Gifford ..... 606/237
4,910,818 A * 3/1990 Grabill et al. ..... 5/650
4,935,972 A 6/1990 Brady
4,989,584 A * 2/1991 Simon ..... 5/915 X
D319,751 S * 9/1991 Hoff ..... D6/601
5,117,522 A * 6/1992 Everett ..... 5/648
5,125,123 A * 6/1992 Engle ..... 5/648
5,134,739 A * 8/1992 Gaffe et al. ..... 5/648
5,216,771 A 6/1993 Hoff
5,269,322 A * 12/1993 Mandel ..... 128/845
D342,856 S * 1/1994 Hagen ..... D6/601
D345,668 S * 4/1994 Braly ..... D6/601
D348,175 S * 6/1994 Kilbey ..... D6/601
D349,541 S * 8/1994 Bertolucci et al. ..... D6/601 X
5,344,437 A * 9/1994 Pistay ..... 5/639 X
5,361,437 A * 11/1994 Zhu et al. ..... 5/639
D366,801 S 2/1996 Gray
D377,881 S 2/1997 Watt
5,652,981 A 8/1997 Singer-Leyton et al.
5,664,271 A * 9/1997 Bellavance ..... 5/648 X
5,746,218 A * 5/1998 Edge ..... 5/648 X
D394,977 S * 6/1998 Frydman ..... D6/601
5,871,457 A * 2/1999 Swedberg et al. ..... 602/24
5,878,453 A * 3/1999 Stokes ..... 5/648
D413,981 S * 9/1999 Swedberg et al. ..... D24/190
6,145,508 A * 11/2000 Seip, Jr. ..... 128/845
6,154,905 A * 12/2000 Frydman ..... 5/648
6,179,756 B1 * 1/2001 Bertolucci et al. ..... 602/24 X
6,182,314 B1 * 2/2001 Frydman ..... 5/648
D438,624 S * 3/2001 Reina ..... D24/190
6,256,818 B1 * 7/2001 Hughes ..... 5/639

* cited by examiner

*Primary Examiner*—Robert G. Santos

(57) ABSTRACT

A knee pillow for separating the knees of person while lying on their side. The knee pillow includes a pillow. The pillow comprises a cushion portion. The cushion portion has a top wall, a bottom wall, a back wall, a front wall, a first side wall, a second side wall. The front wall has a length at least twice a length of the back wall. The first and second side walls taper from the front wall to the back wall. The cushion portion has a concave shaped depression therein extending about the cushion portion such that the depression is positioned in the front, back, top and bottom walls.

7 Claims, 3 Drawing Sheets

KNEE PILLOW

BACKGROUND OF THE INVENTION

1. Field of the Invention

The present invention relates to pillow devices and more particularly pertains to a new knee pillow for separating the knees of person while lying on their side.

2. Description of the Prior Art

The use of pillow devices is known in the prior art. More specifically, pillow devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,177,806; 5,216,771; 4,136,685; U.S. Des. Pat. No. 377,881; U.S. Pat. Nos. 5,652,981; 4,935,972; and U.S. Des. Pat. No. 366,801.

While these devices fulfill their respective, particular objectives and requirements, the aforementioned patents do not disclose a new knee pillow. The inventive device includes a pillow. The pillow comprises a cushion portion. The cushion portion has a top wall, a bottom wall, a back wall, a front wall, a first side wall, a second side wall. The front wall has a length at least twice a length of the back wall. The first and second side walls taper from the front wall to the back wall. The cushion portion has a concave shaped depression therein extending about the cushion portion such that the depression is positioned in the front, back, top and bottom walls.

In these respects, the knee pillow according to the present invention substantially departs from the conventional concepts and designs of the prior art, and in so doing provides an apparatus primarily developed for the purpose of separating the knees of person while lying on their side.

SUMMARY OF THE INVENTION

In view of the foregoing disadvantages inherent in the known types of pillow devices now present in the prior art, the present invention provides a new knee pillow construction wherein the same can be utilized for separating the knees of person while lying on their side.

The general purpose of the present invention, which will be described subsequently in greater detail, is to provide a new knee pillow apparatus and method which has many of the advantages of the pillow devices mentioned heretofore and many novel features that result in a new knee pillow which is not anticipated, rendered obvious, suggested, or even implied by any of the prior art pillow devices, either alone or in any combination thereof.

To attain this, the present invention generally comprises a pillow. The pillow comprises a cushion portion. The cushion portion has a top wall, a bottom wall, a back wall, a front wall, a first side wall, a second side wall. The front wall has a length at least twice a length of the back wall. The first and second side walls taper from the front wall to the back wall. The cushion portion has a concave shaped depression therein extending about the cushion portion such that the depression is positioned in the front, back, top and bottom walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to: the details of construction and to the arrangements of the components set forth in the following description or illustrated in the drawings. The invention is capable of other embodiments and of being practiced and carried out in various ways. Also, it is to be: understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knee pillow apparatus and method which has many of the advantages of the pillow devices mentioned heretofore and many novel features that result in a new knee pillow which is not anticipated, rendered obvious, suggested, or even implied by any of the prior art pillow devices, either alone or in any combination thereof.

It is another object of the present invention to provide a new knee pillow which may be easily and efficiently manufactured and marketed.

It is a further object of the present invention to provide a new knee pillow which is of a durable and reliable construction.

An even further object of the present invention is to provide a new knee pillow which is susceptible of a low cost of manufacture with regard to both materials and labor, and which accordingly is then susceptible of low prices of sale to the consuming public, thereby making such knee pillow economically available to the buying public.

Still yet another object of the present invention is to provide a new knee pillow which provides in the apparatuses and methods of the prior art some of the advantages thereof, while simultaneously overcoming some of the disadvantages normally associated therewith.

Still another object of the present invention is to provide a new knee pillow for separating the knees of person while lying on their side.

Yet another object of the present invention is to provide a new knee pillow which includes a pillow. The pillow comprises a cushion portion. The cushion portion has a top wall, a bottom wall, a back wall, a front wall, a first side wall, a second side wall. The front wall has a length at least twice a length of the back wall. The first and second side walls taper from the front wall to the back wall. The cushion portion has a concave shaped depression therein extending about the cushion portion such that the depression is positioned in the front, back, top and bottom walls.

Still yet another object of the present invention is to provide a new knee pillow that has a vibrating device for massaging the legs of the user which will turn off when the legs are removed form the device.

Even still another object of the present invention is to provide a new knee pillow that keeps the knees separated so that the hips of the user are in better alignment for comfort while lying on their side.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description reference to the annexed drawings wherein.

DESCRIPTION OF THE PREFERRED EMBODIMENT

Figure 1:
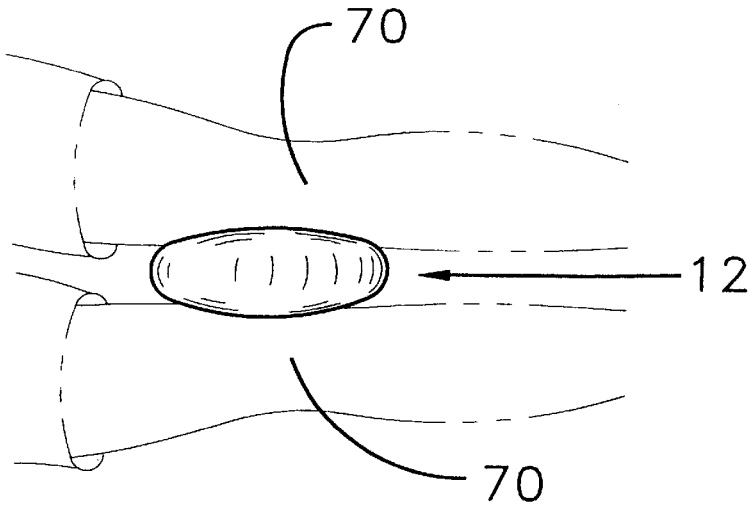
FIG. 1 is a schematic in use view of a new knee pillow according to the present invention.
Figure 2:
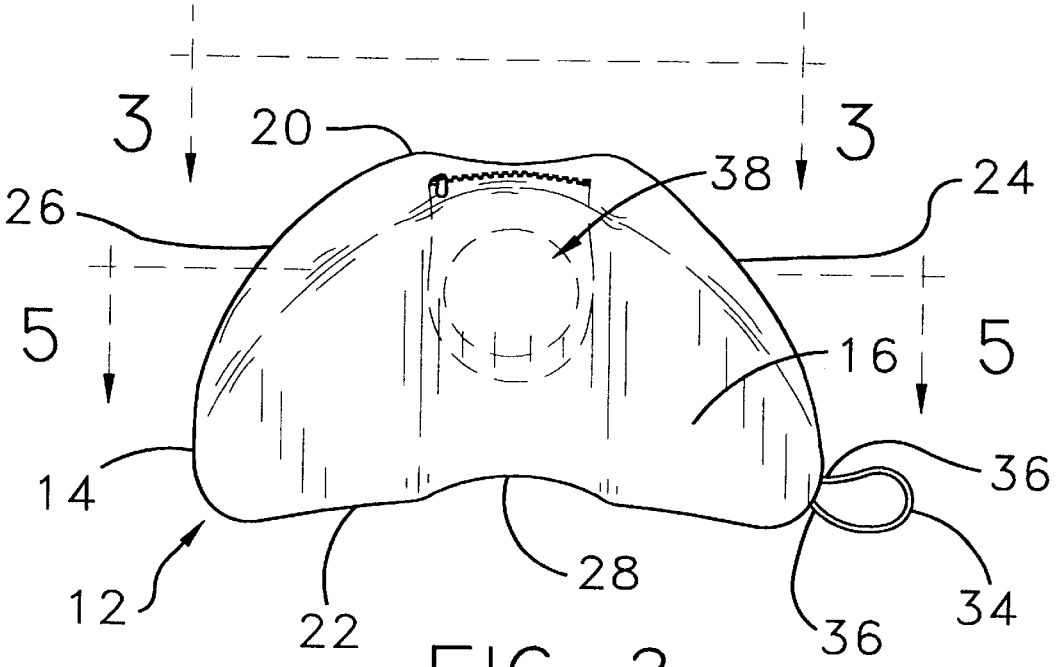
FIG. 2 is a schematic plan view of the present invention.
Figure 3:
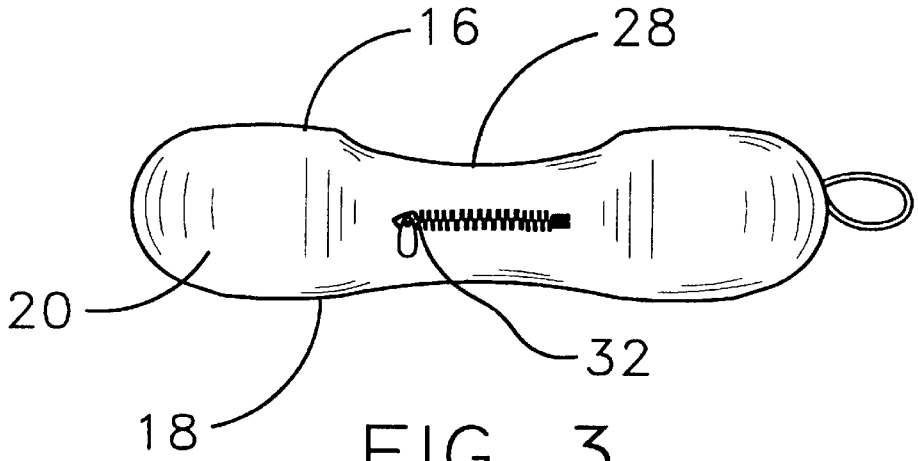
FIG. 3 is schematic side view of the present invention.
Figure 4:
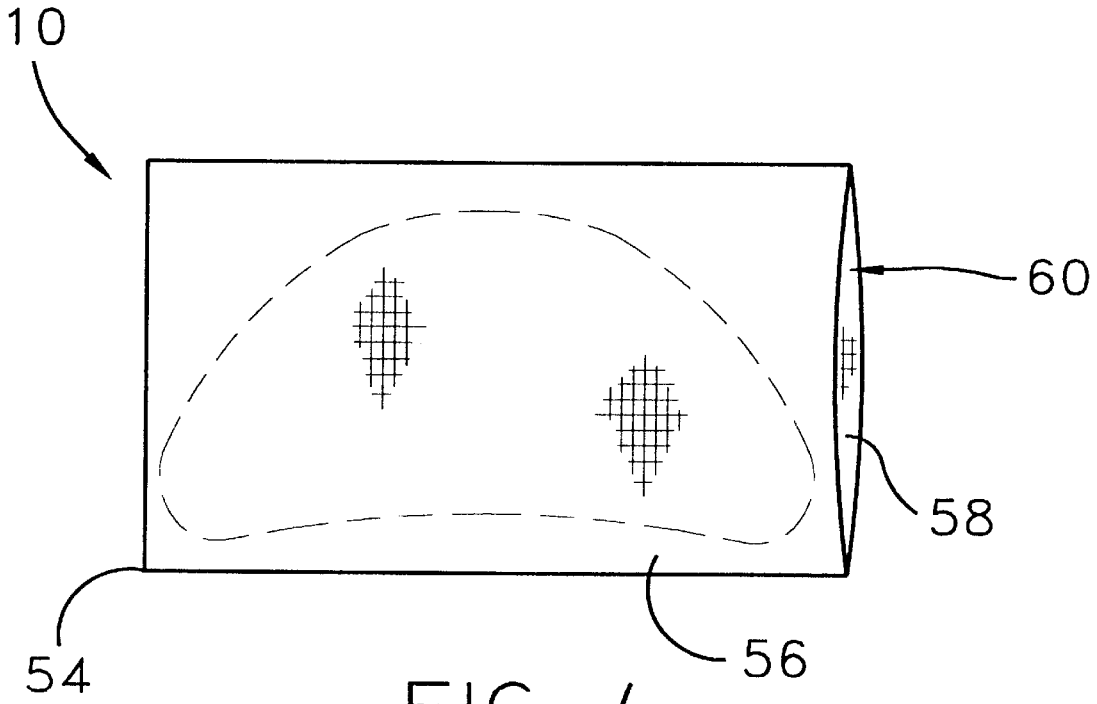
FIG. 4 is a schematic top view of the cover portion of the present invention.
Figure 5:
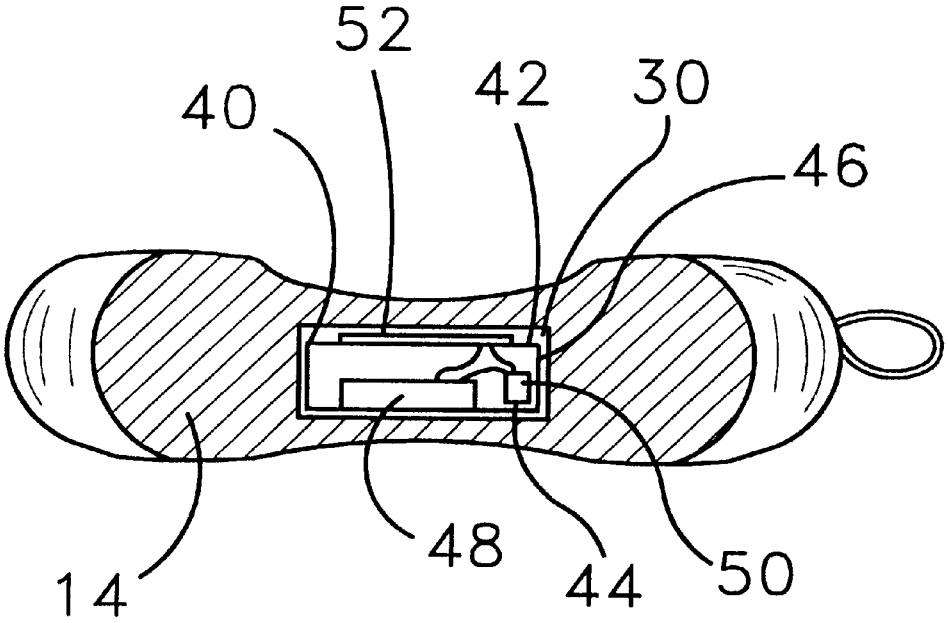
FIG. 5 is a schematic cross-sectional view taken along line 5—5 of the present invention.

With reference now to the drawings, and in particular to FIGS. 1 through 5 thereof, a new knee pillow embodying the principles and concepts of the present invention and generally designated by the reference numeral 10 will be described.

As best illustrated in FIGS. 1 through 5, the knee pillow 10 generally comprises a pillow 12, the pillow 12 includes a cushion portion 14. The cushion portion 14 has a top wall 16, a bottom wall 18, a back wall 20, a front wall 22, a first side wall 24, a second side wall 26. The front wall 22 has a length at least twice, and preferably three times, a length of the back wall 20. The first 24 and second 26 side walls taper from the front wall 22 to the back wall 20. The cushion portion 14 has a concave shaped depression 28 therein extending about the cushion portion 14 such that the depression 28 is positioned in the front 22, back 20, top 16 and bottom 18 walls. The cushion portion 14 has a well 30 extending therein. The well 30 is positioned in the back wall 20. The cushion portion 14 comprises a foamed elastomeric material. The measurements of the cushion portion 14 are preferably 10–14 inches long, 6–9 inches wide and 3–5 inches high.

A closing means 32 for selectively closing the well 30 preferably comprises a zipper.

A carrying means 34 for carrying the cushion portion 14 comprising a loop having a pair of ends 36. Each of the ends 36 is securely coupled to the first side wall 24.

A vibrating member 38 is removably positioned in the well 30. The vibrating member comprises 38 a housing 40 having a top side 42, a bottom side 44 and a peripheral wall 46 extending therebetween. A motor 48 adapted for oscillating the housing 40 is mounted in the housing 40. A power supply 50 is operationally coupled to the motor 48. The power supply is preferably a battery that is removably from the housing 40. An actuating means 52 for turning the motor 48 on and off is mounted on the top side 42 of the housing 40. The actuating means 52 is operationally coupled to the motor 48. The actuating means 52 is a pressure switch such that pressure on the top side 42 turns the motor on.

A covering portion 54 comprises a top panel 56 and a bottom panel 58. The panels 56, 58 are securely attached at their peripheral edges to define a pillowcase. The pillowcase has an opening 60 therein for receiving the cushion portion 14. The covering portion 54 preferably comprises a cloth material.

In use, the cushion member 14 is placed between the knees 70 of a user such that the knees 70 are in the depression 28 and the side walls 24, 26 each face away from the knees 70. The vibrating member 38 may be placed in the well 30. The pressure of the knees 70 on the actuating means 52 causes the vibrating member 38 to turn on and massage the knees 70. The covering portion 54 helps to keep the cushion member 14 clean.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A leg pillow device comprising:

a pillow comprising a cushion portion, said cushion portion having a top wall, a bottom wall, a back wall, a front wall, a first side wall, a second side wall, said front wall having a length at least twice a length of said back wall, said first and second side walls tapering from said front wall to said back wall, said cushion portion having a concave shaped depression therein extending around said cushion portion such that said depression is positioned in said front, back, top and bottom walls to form substantially straight channels in the top and bottom walls each extending from said back wall to said front wall, said depression forming substantially straight channels in said front and back walls and extending from said channel in said top wall to said channel in said bottom walls, wherein said channels in said top and bottom walls may receive a portion of the user's leg adjacent the knee.

2. The leg pillow device as in claim 1, wherein said cushion portion has a well extending therein, said device further including a vibrating member for creating a vibrating sensation through said cushion portion, said vibrating member being removably positioned in said well.

3. The leg pillow device as in claim 2, wherein said vibrating member comprises:

a housing having a top side, a bottom side and a peripheral wall extending therebetween;

a motor adapted for oscillating said housing, said motor being mounted in said housing;

a power supply being operationally coupled to said motor;

an actuating means for turning said motor on and off, said actuating means being mounted on said top side of said housing, said actuating means being operationally coupled to said motor, said actuating means being a pressure switch such that pressure on said top side turns said motor on.

4. The leg pillow device as in claim 2, further comprising a closing means for selectively closing said well, said closing means comprising a zipper.

5. The leg pillow device as in claim 4, further comprising a carrying means for carrying said cushion portion, said carrying means comprising a loop having a pair of ends, each of said ends being securely coupled to said first side wall.

6. The leg pillow device as in claim 2, further including a covering portion comprising a top panel and a bottom panel, said panels being securely attached at their peripheral edges to define a pillowcase, said pillowcase having an opening therein for receiving said cushion portion said covering portion comprising a cloth material.

7. A leg pillow device comprising:

a pillow including;

a cushion portion having a top wall, a bottom wall, a back wall, a front wall, a first side wall, a second side wall, said front wall having a length at least twice a length of said back wall, said first and second side walls tapering from said front wall to said back wall, said cushion portion having a concave shaped depression therein extending about said cushion portion such that said depression is positioned in said front, back, top and bottom walls to form substantially straight channels in the top and bottom walls each extending from said back wall to said front wall, said depression forming substantially straight channels in said front and back walls and extending from said channel in said top wall to said channel in said bottom walls, wherein said channels in said top and bottom walls may receive a portion of the user's leg adjacent the knee, said cushion portion having a well extending therein, said well being positioned in said back wall, said cushion portion comprising a foamed elastomeric material;

a closing means for selectively closing said well, said closing means comprising a zipper;

a carrying means for carrying said cushion portion, said carrying means comprising a loop having a pair of ends, each of said ends being securely coupled to said first side wall;

a vibrating member being removably positioned in said well, said vibrating member comprising;

a housing having a top side, a bottom side and a peripheral wall extending therebetween;

a motor adapted for oscillating said housing, said motor being mounted in said housing;

a power supply, said power supply being operationally coupled to said motor;

an actuating means for turning said motor on and off, said actuating means being mounted on said top side of said housing, said actuating means being operationally coupled to said motor, said actuating means being a pressure switch such that pressure on said top side turns said motor on; and a covering portion comprising a top panel and a bottom panel, said panels being securely attached at their peripheral edges to define a pillowcase, said pillowcase having an opening therein for receiving said cushion portion said covering portion comprising a cloth material.

* * * * *